United States Patent [19]

Yang et al.

[11] Patent Number: 4,895,607

[45] Date of Patent: Jan. 23, 1990

[54] IRON-NEODYMIUM-BORON PERMANENT MAGNET ALLOYS PREPARED BY CONSOLIDATION OF AMORPHOUS POWDERS

[75] Inventors: Choong-Jin Yang, Lowell; Ranjan Ray, Andover, both of Mass.

[73] Assignee: Kubota, Ltd., Osaka, Japan

[21] Appl. No.: 223,625

[22] Filed: Jul. 25, 1988

[51] Int. Cl.[4] ..... H01F 1/02

[52] U.S. Cl. ..... 148/104; 148/101; 148/302; 164/463

[58] Field of Search ..... 419/12, 31, 33, 38; 148/101, 102, 103, 104, 302; 420/83, 121; 164/463, 477

[56] References Cited

U.S. PATENT DOCUMENTS 4,792,367 12/1988 Lee ..... 148/104

FOREIGN PATENT DOCUMENTS 0133758 3/1985 European Pat. Off. ..... 148/302

62-291903 12/1987 Japan ..... 148/101

63-115307 5/1988 Japan ..... 148/102

*Primary Examiner*—John P. Sheehan

*Attorney, Agent, or Firm*—Armstrong, Nikaido, Marmelstein, Kubovcik & Murray

[57] ABSTRACT

New Iron-Neodymium-Boron base alloys containing diboride based on zirconium, titanium or tantalum are disclosed. The alloys are subjected to rapid solidification processing technique which produces cooling rates between $10^5$ to $10^7$ °C./second. The as-quenched filament, ribbon or particulate, powder etc. consists predominantly of a single amorphous phase. The amorphous powder is consolidated into bulk shapes by the method of hot extrusion. The bulk alloys consist of a ultrafine grained homogeneous crystalline phase dispersed with ultrafine sized particles of zirconium diboride, titanium diboride or tantalum diboride either singly or combined. The bulk alloys exhibit superior hard magnetic properties suitable for many engineering and scientific applications.

3 Claims, No Drawings

IRON-NEODYMIUM-BORON PERMANENT MAGNET ALLOYS PREPARED BY CONSOLIDATION OF AMORPHOUS POWDERS

BACKGROUND OF INVENTION

1. Field of the Invention

This invention relates to rapidly solidified ultrafine-grained iron-neodymium-boron alloys obtained by adding small amounts of zirconium diboride, ($ZrB_2$), titanium diboride ($TiB_2$), and tantalum diboride ($TaB_2$). This invention also relates to the preparation of these materials in the form of rapidly solidified powder and consolidation of these powders by the method of hot extrusion into fully dense bulk magnets having high energy product values.

2. Description of the Prior Art

Permanent magnet materials are distinguished by microstructures including two magnetically different phases on an extremely fine scale, as in the Alnicos and Fe—Cr—Co alloys, high magnetocrystalline anisotropy, as in Co—Sm and the barium ferrites, or as in the copper modified cobalt-rare earths and their descendants. These microstructures result from various combinations of processing and heat treatment. Such structures can also be produced by crystallizing amorphous alloys or directly by rapid quenching. These processes lead to fine-scale heterogeneity and can also result in the production of phases, for example, $Fe_3B$, (see J. J. Rhyne, J. H. Schelleng and N. D. Koon in Physical Review. B10, pp 4672, 1974) that would not be stable under more nearly equilibrium conditions. Such phases may have low symmetry and possibly high magnetocrystalline anisotropy. For all these reasons crystallized amorphous materials seemed attractive to explore for potential permanent magnet properties.

The highest coercive forces and energy products $(BH)_{max}$ among commercial permanent magnet materials are found in cobalt-samarium alloys. The high coercivity results from the very high magnetocrystalline anisotropy that can occur in intermetallic compounds containing transition metals and rare earths. In search of new cobalt and samarium-free permanent magnet materials, the early studies (see R. C. Taylor in J. Appl. Physics, 47, pp 1164, 1976) have been made on amorphous $RFe_2$(R=rare earth) prepared by rapid quenching having large coercivities at cryogenic temperatures. Since then similar behavior has been observed in other rare earth systems (see A. E. Clark in Appl. Physics Letter, 23, pp 642, 1973 and J. J. Croat in Appl. Physics Letter, 37, pp 1096, 1980). The philosophy of the technical approach is to utilize the wide range of metastable microstructures accessible by rapid quenching at controlled rates followed (if desired) by heat treatment. The hard magnetic properties of these amorphous materials have been observed to increase with crystallization and Clark obtained a coercive field of 3.4KOe and an energy product of 9MGOe in $TbFe_2$ at room temperature. More recently Koon et al (see N. C. Koon and B. N. Das, Appl. Physics Letter, 39, pp 840, 1981) have observed high coercive fields in $(Fe_{80}B_{20})_{90}La_5$ $Tb_5$ alloys crystallized from amorphous state. Continuing this effort Croat (see J. J. Croat, in J. Appl. Physics, 53, pp 3161, 1982) produced high coercive fields in rapidly solidified ribbons of $R_{40}Fe_{60}$ alloys. Hadjipanayis et al (see G. C. Hadjipanyis, R. C. Hazelton, and K. R. Lawless J. Appl. Phys. 55, pp 2073, 1984) investigated magnetic properties of rapidly quenched ribbons of FeRM alloys where R=La,Y,Pr,Nd,Gd, and M=B,Si,Al,-Ga,Ge over a wide range of chemical compositions. The alloys are generally magnetically soft in as-quenched amorphous state. Magnetic hardening is produced by crystallizing the amorphous phase by heat treatment at 700° C.. The best properties have been obtained in alloys based on iron-neodymium-boron (Fe-Nd-B) and iron-praseodymium-boron (Fe-Pr-B) systems. The hard magnetic properties of these materials are attributed to a highly anisotropic phase. X-ray diffraction and transmission electron microscopy (TEM) indicate that the high energy product alloys in the R-Fe-B systems crystallized from amorphous state consist of an extremely fine grained equilibrium phase. This phase is $R_2Fe_{14}B$ according to Croat et al (see J. J. Croat, J. F. Herbst, R. W. Lee and F. E. Pinkerton, in 29th Annual Conf. on Magnetism and Magnetic Materials, Pittsburgh, Pa, November, 1983). Other researchers have identified the stoichiometry of this phase to be $R_3Fe_{16}B$,$R_3Fe_{20}B$, or $R_3Fe_{21}B$ (see G. C. Hadjipanyis, R. C. Hazelton and K. Lawless, J. Appl. Phys. Lett. 43, pp 797, 1983). The hard magnetic phase has a tetragonal crystal structure with lattice constants a=8.8A and c=12.2A. The Curie temperature of this phase is 600 K.°. The transmission electron microscopy results showed that the particles composing the magnetically hard samples in R-Fe-B alloys are roughly spherical with diameter ranging from 20 to 100 nm. Croat et al (see J. J. Croat et al in 29th Annual Conference on Magnetism and Magnetic Materials, Pittsburgh, Pa., November 1983) estimated a range of 80–100 nm for the single domain particle diameter using the observed Curie temperature and estimates of the exchange and anisotropy energies. The high coercivity mechanism is attributed to the effects due to the single domain particle. Limited studies of the effect of heat treatment variables have shown that the magnetic hardness to be a sensitive property of the anneal temperature. With increasing heat treatment temperature, the particle size of the hard magnetic phase in the crystallized alloy increases, leading to decrease in the coercivity due to multidomain effects.

Although promising permanent magnet alloy compositions have been identified in the light rare earth-iron-boron systems prepared as films or ribbons utilizing various rapid quenching techniques, there is a need to develop a technology to fabricate such alloys in bulk shapes with sufficient strength and improved magnetic properties for practical engineering applications. There has been no effort so far to develop techniques to consolidate the rapidly solidified films or ribbons in fully dense bulk shapes with high structural integrity. Most importantly, appropriate consolidation processing techniques must be developed for the rapidly quenched amorphous alloys (films, ribbons or particulates) so that in the final bulk products, the hard magnetic phase remains as ultrafine magnetically aligned particles.

SUMMARY OF THE INVENTION

This invention features a class of iron-neodymium-boron base permanent magnet alloys having high energy product values and high structural integrity when the production of these alloys includes a rapid solidification process and powder metallurgical consolidation based on the hot extrusion technique. These alloys can be described by the following compositions:

$Fe_aCo_bNd_cR_dM_eB_f$ containing 0.3 to 3 weight percent $PB_g$.

Wherein Fe,Co,Nd and B are iron, cobalt, neodymium, and boron respectively. R is one element from the group consisting of lanthanum (La), yttrium (Y), cerium (Ce), dysprosium (Dy), terbium (Tb), gadolinium (Gd) and praseodymium (Pr) and mixtures thereof, and M is at least one element from the group consisting of aluminum (Al), silicon (Si), germanium (Ge), niobium (Nb) and gallium (Ga) and mixtures thereof, P is one element from the group consisting of zirconium (Zr), titanium (Ti), and tantalum (Ta) and wherein a,b,c,d,e,f, and g represent the ranges of atom percentages having the values a=65 to 84, b=0–25, c=5–20, d=0–10, e=0–5 f=3–10 and g=2 respectively with the provisos that the sum (a+b+c+d+e+f) must be 100.

Preferably, neodymium is present in an amount of about 12 to 16 atom percent, boron is present in an amount about 7 to 10 atom percent of the total alloy composition and also, preferably metal diboride (i.e. either tantalum diboride ($TaB_2$), zirconium diboride ($ZrB_2$) or titanium diboride ($TiB_2$)) and is present in the range from 1 to 2 weight percent to attain superior permanent magnet properties, good structural integrity and homogeneous microstructures.

Rapid solidification processing (RSP) (i.e. processing in which the liquid alloy is subjected to cooling rates of the order of $10^5$ and $10^7$° C./sec.) of such alloys produces predominantly a metallic glass (i.e. amorphous) structure which is chemically homogeneous and can be heat treated and/or thermomechanically processed so as to form crystalline alloy with ultrafine grain structure containing a fine dispersion of zirconium diboride, titanium diboride or tantalum diboride dispersoids. The alloy is prepared as rapidly solidified filament, ribbon or particulate by melt spinning techniques. The as quenched ribbon or filament is brittle and is readily communited to powder using standard pulverization techniques e.g. rotating hammer mill. The amorphous powder is consolidated into bulk shapes consisting of fine grained crystalline phases using conventional hot extrusion process. The final consolidated products are fully dense with good permanent magnet properties.

DETAILED DESCRIPTION OF THE INVENTION

In accordance with the present invention, iron base alloys containing 5 to 20 atom percent neodymium and 3 to 10 atom percent of boron are alloyed with the following constituents: 0–25 atom percent of Co, 0–10 atom percent of La,Y,Ce,Dy,Tb,Gd and Pr either singly or combined, 0 to 5 atom percent of Al, Si, Nb and Ga either singly or combined and 0.3 to 3 weight percent of titanium diboride, zirconium diboride or tantalum diboride. The alloys may also contain limited amounts of other elements which are commercially found in iron base alloys without changing the essential behavior of the alloys. Typical examples include ($Fe_{78}Nd_{16}B_6$+1% $ZrB_2$), ($Fe_{68}Co_{10}Nd_{14}Dy_2B_6$+0.8% $TiB_2$), ($Fe_{62}Co_8Nd_{16}Pr_2Dy_3Al_2B_8$+1.4% $TaB_2$), ($Fe_{73}Co_5Nd_8Ce_2Dy_4Pr_3Al_1Si_2Ga_1B_9$+0.3% $TaB_2$) and ($Fe_{74}Co_4Nd_{12}Y_1Pr_1Ge_2B_6$+1% $TiB_2$).

The alloys of the present invention upon rapid solidification processing the melt by melt spinning chill casting process at cooling rates of the order $10^5$ to $10^7$° C./second form ribbons, filaments or powders with average particle size less than 60 mesh (U.S. standard) consisting predominantly of metallic glass (i.e. amorphous structure) with high degree of compositional uniformity. The melt spun ribbons or filaments are readily pulverized into powders having particle size less than 60 mesh comprising platelets having an average thickness less than 100 micrometer and each platelet being characterized by an irregularly shaped outline resulting from fracture thereof.

The melt spinning method referred to herein includes any of the processes such as single roll chill block casting, double roll quenching, melt extraction, melt drag, etc., where a thin layer of molten metal or alloy is brought in contact with a chill solid substrate moving at a high speed.

The energy product value of permanent magnet is determined by its remanent magnetization i.e. remanence and extrinsic coercivity. With increase in the values of remanence and extrinsic coercivity, the energy product value of the permanent magnet is enhanced.

In accordance with the present invention, improved magnets are prepared via enhancement of extrinsic coercivity and remanence which are obtained via control of alloying additions, modification of microstructure and rapid solidification powder metallurgical processing techniques.

A small amount of metal diboride additions in the concentration range from 0.3 to 3 weight percent to the present alloys was found to be critical to achieve the most desirable properties in the bulk magnets made from such alloys. The metal elements (Ti, Zr or Ta) and boron are retained in solution in the rapidly solidified amorphous phase. During subsequent heat treatment, the amorphous phase is recrystallized into aggregate of microcrystalline phases. The metal elements and boron form ultrafine particles of metal diboride which predominantly act to stabilize the fine grains of iron-neodymium-boron ($Fe_{14}Nd_2B$) magnetic phase. During hot extrusion of rapidly solidified powders, the fine dispersion of metal diboride prevents the iron-neodymium-boron grains from coarsening.

At metal diboride contents below 0.3 wt%, the volume fraction of metal diboride dispersoids in the alloy is too little to cause effective grain refinement of the alloys. When metal diboride contents in the alloy exceeds 3 wt%, the excessive amount of dispersoids is formed. The consolidated magnets are very brittle due to excessive amounts of metal diboride phase exhibiting undesirable mechanical properties as well as decreased magnetization moment.

The microcrystalline iron-neodymium-boron magnet alloys consolidated in the temperature range of 800°–1100° C. from amorphous powders, has matrix grain size of less than 5 microns, preferably less than 2 microns randomly interspersed with particles of metal diboride (i.e. zirconium diboride, titanium diboride or tantalum diboride) having an average particle size measured in its largest dimension of less than 0.5 micron, preferably less than 0.2 micron and said metal diboride particles being predominantly located at grain boundaries and grain boundary junctions.

The iron-neodymium-boron alloys without metal diboride contents when consolidated in the temperature range from 800° to 1100° C. exhibit relatively large grains of the order of 15 to 20 microns.

The effect of fine grains is to increase the coercivities (intrinsic and extrinsic) of the magnets. The magnetic domains generally nucleate at heterogeneous sites such as grain boundaries. The domains nucleated at grain boundaries become pinned by fine dispersoids of metal diboride and the motion of domain wall necessary for the growth of the domains becomes more difficult and require higher magnetizing force.

The method of consolidation via the hot extrusion was found to be beneficial to cause improvement in the magnetic properties of the present magnet alloys via enhancement of remanence. When the amorphous powders are hot extruded, the crystallization of iron-neodymium-boron base phase ($Fe_{14}Nd_2B$) having a long tetragonal crystal structure takes place. The individual grains remain very fine as their growth is inhibited by formation of ultrafine metal diboride dispersoids at the grain boundaries. Also, due to the stress boundary conditions which exist during the extrusion step, the crystals of iron-neodymium-boron base phase undergo preferred orientation in the extruded bar. A predominant percentage of these crystals become oriented with their (001) plane parallel to the extrusion axis. The c-axis of the iron-neodymium-boron ($Fe_{14}Nd_2B$) crystals predominantly lie perpendicular to the extrusion axis. The c-axis of the iron-neodymium-boron crystalline phase is also the direction along which the magnetization of the tetragonal crystalline phase can be easily accomplished, and hence alignment of many crystals with their c-axes perpendicular to the extrusion axis enhance the overall remanent magnetization of the bulk magnet along the perpendicular direction.

The hot extruded magnets made from rapidly quenched amorphous powders are aged at 650°-750° C. for 1 hour followed by fast cooling to room temperature. During hot extrusion, some neodymium rich phase having the composition $Nd_{17}Fe_3$ is formed as revealed by Scanning Electron Microscopy at the boundaries between the primary grains of the hard magnetic phase based on Fe—Nd—B. The aging treatment modifies the morphology of the $Nd_{17}Fe_3$ phase from discontinuous particles to continuous film and improves the extrinsic coercivity of the consolidated magnets.

EXAMPLES 1 to 20

Selected Fe—Nd—B base alloys containing 0–25 atom percent of Co, 0–10 atom percent of La, Y, Ce, Dy, Tb, Gd and Pr either singly or combined and 0–5 atom percent of Al, Si, Ge, Nb or Ga either singly or combined are alloyed with 0.3 to 3 weight percent of metal diboride ($TiB_2$, $ZrB_2$ or $TaB_2$). The metal diboride containing alloys are melt spun into filaments, 10 to 50 microns thick and 400 to 500 microns wide by the rapid solidification technique of melt spinning using a rotating copper-beryllium cylinder having a quench surface speed of 40 m/sec. The filaments are found by X-ray diffraction analysis to consist predominantly of an amorphous phase. The compositions of the alloys are listed in Table 1.

TABLE 1

| Example | Alloy Composition | Structure of melt spun filaments by X-ray diffraction |
|---|---|---|
| 1 | $Fe_{78}Nd_{16}B_6$ + 1% $TiB_2$ | amorphous |
| 2 | $Fe_{68}Co_{10}Nd_{14}Dy_2B_6$ + 0.5% $TiB_2$ | amorphous |
| 3 | $Fe_{66}Co_8Nd_{12}Pr_2Dy_2Al_2B_8$ + 0.3% $TiB_2$ | amorphous |
| 4 | $Fe_{66}Co_8Nd_{12}Pr_2Dy_2Al_2B_8$ + 1.4% $TiB_2$ | amorphous |
| 5 | $Fe_{74}Co_4Nd_{12}Y_1Pr_1Ge_2B_6$ + 2% $ZrB_2$ | amorphous |
| 6 | $Fe_{70}Co_8Nd_{16}Si_1B_5$ + 3% $ZrB_2$ | amorphous |
| 7 | $Fe_{70}Co_{10}Nd_{12}Al_2B_6$ + 1.5% $TiB_2$ | amorphous |
| 8 | $Fe_{67}Co_{10}Nd_{13}Ga_2Al_1Si_1B_6$ + 1.0% $TiB_2$ | amorphous |
| 9 | $Fe_{67}Co_{10}Dy_3Nd_{10}Ge_1Si_2B_7$ + 0.8% $TiB_2$ | amorphous |
| 10 | $Fe_{70}Nd_{16}Ce_2Tb_2Y_2B_8$ + 1.2% $ZrB_2$ | amorphous |
| 11 | $Fe_{78}Nd_{16}B_6$ + 1% $ZrB_2$ | amorphous |
| 12 | $Fe_{65}Co_{10}Nd_{16}Dy_3B_6$ + 1.5% $ZrB_2$ | amorphous |
| 13 | $Fe_{67}Co_9Nd_{12}Dy_3Al_2B_7$ + 2% $TaB_2$ | amorphous |
| 14 | $Fe_{70}Co_{10}Nd_{10}Si_2Al_2B_6$ + 1.5% $TaB_2$ | amorphous |
| 15 | $Fe_{68}Co_8Nd_{12}Dy_4B_8$ + 1.0% $ZrB_2$ | amorphous |
| 16 | $Fe_{78}Nd_{12}Al_2B_8$ + 1.0% $TaB_2$ | amorphous |
| 17 | $Fe_{68}Co_{10}Nd_{12}Si_2B_8$ + 0.8% $TaB_2$ | amorphous |
| 18 | $Fe_{70}Co_7Nd_{11}Ga_2Y_2Tb_2B_6$ + 0.5% $TaB_2$ | amorphous |
| 19 | $Fe_{69}Co_8Nd_{12}Ga_2Al_2Si_1B_6$ + 1.2% $TaB_2$ | amorphous |
| 20 | $Fe_{70}Nd_{16}Ce_2Tb_2Y_2B_8$ + 1.2% $TaB_2$ | amorphous |

EXAMPLES 21 to 26

The alloys listed in Table 2 are prepared from constituent elements of high purity (≧99.9%) by the arc melting technique under argon atmosphere. The alloys were subsequently melt spun into filaments consisting predominantly of a single amorphous phase. The filaments are pulverized into powder with average particle size less than 60 mesh (U.S. Standard). Approximately, two pounds of pulverized powders of each alloy are cold compacted into mild steel or non-magnetic stainless steel cans using 50 KSI pressure, followed by hot evacuation at 400° C. until the vacuum reached $0.5\times10^{-6}$ torr when the cans are sealed off. The sealed cans containing tantalum foil as getter are soaked for 1.5 hours at temperatures ranging between 850°-1000° C. and extruded into round, square, rectangular or hollowed ring bars with a reduction ratio ranging between 12:1 to 16:1.

TABLE 2

| Example | Composition | Extrusion Conditions |
|---|---|---|
| 21 | $Fe_{78}Nd_{16}B_6$ + 1% $ZrB_2$ | The billet was soaked at 1000° C. for 1.5 hours and extruded in 16:1 ratio |
| 22 | $Fe_{78}Nd_{15}B_7$ + 1% $TiB_2$ | The billet was soaked at 850° C. for 1.5 hours and extruded at 12:1 ratio |
| 23 | $Fe_{78}Nd_{16}B_6$ + 1% $TaB_2$ | The billet was soaked at 1050° C. for 1.5 hours and extruded at 14:1 ratio |
| 24 | $Fe_{70}Co_8Nd_{14}Si_2B_6$ + 1.5% $TiB_2$ | The billet soaked at 900° C. for 1.5 hours and extruded at 12:1 ratio. |
| 25 | $Fe_{68}Co_8Nd_{12}Dy_2Si_1Al_1B_6$ +0,8% $TiB_2$ | The billet soaked at 1000° C. for 1.5 hours and extruded at 16:1 ratio |
| 26 | $Fe_{74}Nd_{12}Co_2Tb_2Y_2B_8$ + 1.2% $ZrB_2$ | The billet soaked at 980° C. for 2 hours and extruded at 12:1 ratio |

EXAMPLES 27 to 29

The principal magnetic properties of the hot-extruded Fe—Nd—B alloys in as extruded condition are measured along longitudinal and transverse axes of the square bar magnets. The alloys show higher remanent magnetization ($B_r$) and coercivities (intrinsic and extrinsic) along the transverse direction of the extruded bar magnet. The energy product values, $(B\,H)_{max}$ of the extruded magnets are shown in Table 3.

TABLE 3

| Example | Alloy Composition | Energy Product Value $(BH)_{max}$ along the transverse axis | along the longitudinal axis |
|---|---|---|---|
| 27 | $Fe_{78}Nd_{16}B_6$ + 1% $TaB_2$ (extruded at 1000° C.) | 15.0 MGOe | 7.4 MGOe |
| 28 | $Fe_{78}Nd_{15}B_7$ + 1% $TiB_2$ (extruded at 950° C.) | 14.9 MGOe | 7.5 MGOe |
| 29 | $Fe_{76}Nd_{17}B_7$ + 1% $ZrB_2$ (extruded at 1000° C.) | 16.2 MGOe | 8.1 MGOe |

EXAMPLES 30–33

Table 4 lists four alloy compositions based on $Fe_{78}Nd_{16}B_6$. Three of the compositions out of four are modified with one weight percent of metal diboride (i.e. titanium diboride, zirconium diboride or tantalum diboride). The melt spun powders are cold compacted in a mild steel can and hot evacuated at 400° C. followed by sealing off the cans. The sealed cans are heated at 1000° C. for 1.5 hours and extruded into bars with square cross section at a reduction ratio of 16:1. The principal magnetic properties of the alloys are measured along the transverse axes of the bar. The energy product values of the extruded magnet alloys containing metal diboride are found to be significantly higher than the alloy which does not contain metal diboride as shown in Table 4.

TABLE 4

| Example | Alloy Composition | Energy Product, $(BH)_{max}$ along transverse axis of the extruded bar |
|---|---|---|
| 30 | $Fe_{78}Nd_{16}B_6$ | 10.4 MGOe |
| 31 | $Fe_{78}Nd_{16}B_6$ + 1% $TiB_2$ | 14.8 MGOe |
| 32 | $Fe_{78}Nd_{16}B_6$ + 1% $TaB_2$ | 16.1 MGOe |
| 33 | $Fe_{78}Nd_{16}B_6$ + 1% $ZrB_2$ | 16.2 MGOe |

EXAMPLES 34 to 36

Several Fe—Nd—B base alloys are prepared from raw materials of high purity (≧99.9) by arc melting. The alloys are melt spun into amorphous powders. The powders are cold compacted in mild steel cans and hot evacuated to 400° C. and the cans are sealed off. The sealed cans are heated at 1000° C. for 1.5 hours and then extruded at 12:1 into bars having rectangular cross section. The principal magnetic properties of the alloys in as extruded condition as well as in aged condition measured in short transverse (through-thickness) and longitudinal directions of the extruded bars are listed in Table 5.

TABLE 5

| Example | Alloy Composition | Energy Product Value, $(BH)_{max}$ As extruded condition: through-thickness Direction | Longitudinal Direction | MGOe Aged at 650° C. for 1 hour following extrusion: through-thickness Direction | Longitudinal Direction |
|---|---|---|---|---|---|
| 17 | $Fe_{78}Nd_{16}B_6$ + 1% $TiB_2$ | 15.2 | 7.2 | 15.8 | 7.4 |
| 18 | $Fe_{64}Co_{15}Nd_{13}B_6Al_2$ + 1% $ZrB_2$ | 15.6 | 8.3 | 16.2 | 8.8 |
| 19 | $Fe_{68}Co_{10}Nd_{12}Dy_2B_6Al_2$ + 1% $TaB_2$ | 13 | 6.0 | 14 | 7.0 |

Having thus described the invention, what we claim and desire to obtain by Letters Patent of the United States is:

1. A method for preparing a fine grained iron-neodymium-boron bulk-shaped alloy comprising the steps of:

forming an alloy melt having the following composition: $Fe_aCo_bNd_cR_dM_eB_f$ wherein Fe, Co, Nd and B are iron, cobalt, neodymium and boron respectively, and R is an element selected from the group consisting of lanthanum, yttrium, cerium, dysprosium, terbium, gadolinium, and praseodymium and mixtures thereof, and M is an element selected from the group consisting of aluminum, silicon, germanium, niobium and gallium and mixtures thereof, wherein a=65–84, b=0–25, c=5–20, d=0–10, e=0–5 and f=3–10 respectively with the proviso that the sum (a+b+c+d+e+f)=100, adding 0.3 to 3 weight percent of at least one diboride selected from the group consisting of zirconium diboride, titanium diboride and tantalum diboride, to said melt of alloy, depositing said melt against a rapidly moving quench surface adapted to quench said melt at a rate in the range of approximately between $10^5$ to $10^7$° C./second and form a rapidly solidified filament, ribbon or particulate of said alloy characterized predominantly by a single amorphous structure, comminuting said ribbon, filament or particulate into a powder, said powder having an average particle size of less than 60 mesh and consisting of platelets having a thickness of less than 0.1 millimeter, each platelet being defined by an irregularly shaped outline resulting from fracture, and consolidating said powder into a bulk shape consisting of fine grained crystalline phases using hot extrusion.

2. The method as defined in claim 1 wherein the powders are consolidated under vacuum in cans which are sealed, and then extruding the cans at a temperature between 800° to 1100° C. at an extrusion ratio of between 4:1 to 20:1.

3. The method as defined in claim 1 wherein the bulk-shaped alloy has the formula $Fe_{Balance}CO_{0-20}Nd_{12-16}Al_{0-3}Dy_{0-3}B_{7-10}$ and contains 1 to 2 weight percent of at least one diboride selected from the group consisting of zirconium diboride, titanium diboride and tantalum diboride.

* * * * *